US009789596B2

(12) United States Patent
Moriwaki et al.

(10) Patent No.: US 9,789,596 B2
(45) Date of Patent: Oct. 17, 2017

(54) FASTENER DRIVING TOOL

(71) Applicant: MAX CO., LTD., Tokyo (JP)

(72) Inventors: Kousuke Moriwaki, Tokyo (JP); Keisuke Ida, Tokyo (JP); Takamichi Hoshino, Tokyo (JP)

(73) Assignee: MAX CO., LTD., Tokyo (JP)

( * ) Notice: Subject to any disclaimer, the term of this patent is extended or adjusted under 35 U.S.C. 154(b) by 475 days.

(21) Appl. No.: 14/318,897

(22) Filed: Jun. 30, 2014

(65) Prior Publication Data

US 2015/0014388 A1 Jan. 15, 2015

(30) Foreign Application Priority Data

Jul. 4, 2013 (JP) ..... 2013-140474
May 16, 2014 (JP) ..... 2014-102083

(51) Int. Cl.
*B25C 1/18* (2006.01)

(52) U.S. Cl.
CPC ..... *B25C 1/188* (2013.01); *B25C 1/184* (2013.01)

(58) Field of Classification Search
CPC . B25C 1/06; B25C 1/188; B25C 1/184; B25F 5/00
USPC ..... 227/8, 119, 120, 110, 130, 136
See application file for complete search history.

(56) References Cited

U.S. PATENT DOCUMENTS 5,647,525 A * 7/1997 Ishizawa ..... B25C 1/00 227/113
7,988,025 B2 * 8/2011 Terrell ..... B25C 5/1665 227/119
2001/0017311 A1 * 8/2001 Hamano ..... B25C 1/005 227/120
2001/0022313 A1 * 9/2001 Hamano ..... B25C 1/005 227/119
2002/0027150 A1 * 3/2002 Hamada ..... B25C 1/00 227/119
2004/0149800 A1 * 8/2004 Perra ..... B25C 1/008 227/8
2008/0277446 A1 11/2008 Yamamoto et al.

FOREIGN PATENT DOCUMENTS

JP A-2005-313284 11/2005
JP 2007-203419 A 8/2007
JP A-2011-36967 2/2011

* cited by examiner

*Primary Examiner* — Nathaniel Chukwurah
(74) *Attorney, Agent, or Firm* — Drinker Biddle & Reath LLP

(57) ABSTRACT

A fastener driving tool injects a fastener from an injection passage formed in a leading end of a tool main body. The injection passage includes therein a guide portion formed along a driving direction of the fastener for guiding the fastener. The guide portion is formed by providing contours having mutually different distances from a center of the injection passage in a cross-section of the injection passage.

10 Claims, 12 Drawing Sheets

FIG.9A
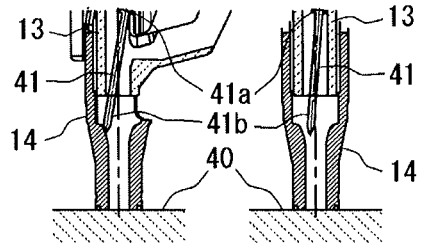
FIG.9F
FIG.9B
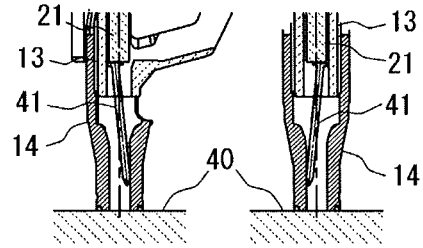
FIG.9G
FIG.9C
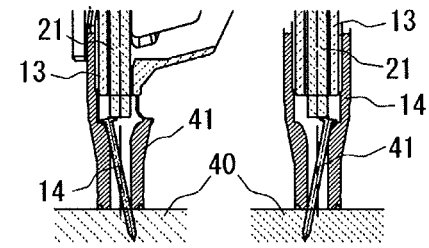
FIG.9H
FIG.9D
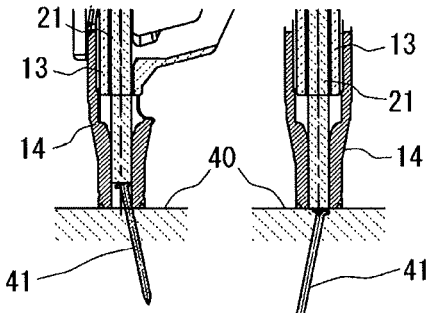
FIG.9I
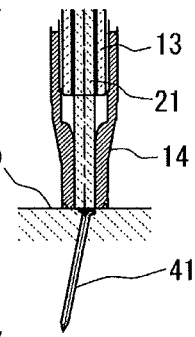
FIG.9E
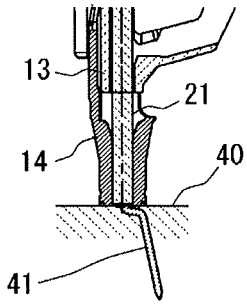

FASTENER DRIVING TOOL

CROSS-REFERENCE TO RELATED APPLICATION

This application is based on and claims priority under 35 USC119 from Japanese Patent Application Nos. 2013-140474 filed on Jul. 4, 2013 and 2014-102083 filed on May 16, 2014.

TECHNICAL FIELD

The invention relates to a fastener driving tool.

BACKGROUND

A conventional fastener driving tool has a tendency that, with use of a fastener having small head and line diameters and a short length, when the fastener is driven within an injection passage, its inclination angle is increased to thereby increase the frequency of occurrence of fastener buckling.

To prevent such poor driving (bucking), conventionally, there is used a contact nose (see, for example, JP-A-2007-203419). The contact nose is a member to be connected to the leading end of a contact arm constituting a safety device of a fastener driving tool and, when the contact nose is pressed against the surface of a driven member, the contact arm is moved upward to put a drive mechanism into a drivable state. When the inside diameter of the contact nose is formed substantially equal to the inside diameter of a nose portion of the tool, the inclination of the fastener in driving can be prevented. Also, the contact nose is formed such that, in fastener driving, it is projected beyond the nose portion and is contacted with the driven member to thereby drive out the fastener from an injection port formed in its leading end. Therefore, even while the nose portion is floating due to reaction generated in the fastener driving, the adjustment of the fastener driving depth and the like, the contact of the contact nose with the driven member can be maintained, whereby the attitude of the fastener can be guided up to the completion of the driving operation. That is, even with use of the fastener having small head and line diameters and a short length, the contact nose can prevent the inclination of the fastener to thereby reduce the occurrence frequency of the fastener buckling.

SUMMARY

Here, this type of fastener driving tool mostly corresponds to multiple kinds of fasteners having different head and line diameters. Therefore, even when the contact nose structure is employed, the inside diameter of the contact nose must be formed to fit the maximum diameter of the fastener. Thus, when a fastener having small head and line diameters is used, the inclination of the fastener within the contact nose cannot be prevented completely, thereby raising a fear that the faster can be inclined injected into buckling.

Especially, in a driving tool having a fastener supply mechanism for supplying connected fasteners one by one into the injection passage of the nose, since the fastener is driven out in an insufficient guide state, the attitude of the driven-out fastener is not constant. Thus, even with use of the contact nose structure, the inclination of the fastener cannot be prevented completely.

Thus, the invention aims at providing a fastener driving tool which can control the attitude of a fastener to thereby stabilize the fastener driving and thus reduce the occurrence frequency of the fastener buckling.

This invention aims to solve the above issues and has the following features.

The invention described in embodiment 1 has the following features.

A fastener driving tool injects a fastener from an injection passage formed in a leading end of a tool main body. The injection passage includes therein a guide portion formed along a driving direction of the fastener for guiding the fastener. The guide portion is formed by providing contours having mutually different distances from a center of the injection passage in a cross-section of the injection passage.

The invention described in embodiment 2 has the following feature in addition to the invention having the above features described in embodiment 1.

The guide portion is formed in an inner surface of the injection passage at an opposite side of a grip.

The invention described in embodiment 3 has the following feature in addition to the invention having the above features described in embodiments 1 or 2.

The guide portion is formed of a guide groove.

The invention described in embodiment 4 has the following feature in addition to the invention having the above features described in embodiment 3.

The guide groove has a width smaller than a diameter of a head of the fastener.

The invention described in embodiment 5 has the following feature in addition to the invention having the above features described in embodiments 3 or 4.

The guide groove has a depth smaller than a diameter of a shaft portion of the fastener.

The invention described in embodiment 6 has the following feature in addition to the invention having the above features described in any one of embodiments 3 through 5.

A second groove is formed shallower than the guide groove.

The invention described in embodiment 7 has the following feature in addition to the invention having the above features described in any one of embodiments 1 through 6.

A supply passage for supplying the fastener is connected to the injection passage. The supply passage is disposed offset to a center position of the injection passage.

The invention described in embodiment 8 has the following feature in addition to the invention having the above features described in any one of embodiments 1 through 7.

The guide portion is formed nearer to the leading end of the tool main body than a leading end of a fastener supplied to the injection passage.

The invention described in embodiment 9 has the following feature in addition to the invention having the above features described in any one of embodiments 1 through 8.

A supply passage for supplying the fastener is connected to the injection passage. The guide portion is formed nearer to the leading end of tool main body than the supply passage.

The invention according to embodiment 1 is as described above. Specifically, the injection passage includes therein the guide portion formed along the fastener driving direction for guiding the fastener, and the guide portion is formed by providing contours having mutually different distances from the center of the section of the injection passage. Thus, the tiptoe of the fastener injected from the nose portion is guided by the guide portion to thereby restrict the attitude of the fastener within the injection passage. This can stabilize the fastener driving attitude to thereby reduce the occurrence frequency of poor driving of the fastener.

By guiding the fastener tiptoe, the relative position of the fastener tiptoe to the injection port is limited and thus the fastener landing position on a driven member is limited, thereby allowing the facilitated aim of the driving position.

The invention according to embodiment 2 is as described above. Specifically, the guide portion is formed in such inner surface of the injection passage as exists opposite to the grip of the tool. When the guide groove is formed at such position, the tiptoe of the fastener having entered the guide groove is guided inclined in the opposite direction to the grip. And, when the fastener driving tool is inclined due to a reaction in driving in a direction where its opposite side to the grip is lifted, the shaft of the fastener approaches the driven surface perpendicularly, whereby the inclination of the fastener is absorbed and thus the fastener can be driven substantially perpendicularly.

The invention according to embodiment 3 is as described above. Specifically, since the guide portion is constituted of a guide groove, the tiptoe of the fastener within the injection passage can be caught positively to thereby stabilize the attitude of the fastener within the injection passage.

The invention according to embodiment 4 is as described above. Specifically, since the guide groove has a width smaller than the diameter of the head of the fastener, the fastener head is prevented from entering the guide groove and thus, using the inner peripheral surface (other portion than the guide groove) of the injection passage, the fastener head can be positively guided and thus the attitude of the fastener within the injection passage can be stabilized.

The invention according to embodiment 5 is as described above. Specifically, since the guide groove has a depth smaller than the diameter of the shaft portion of the fastener, the fastener shaft portion is prevented from entering the guide groove more than necessary, thereby eliminating a problem that the fastener driving position can be shifted by the guide groove.

The invention according to embodiment 6 is as described above. Specifically, since there is formed the second groove shallower than the guide groove, while the lateral movement of the fastener tiptoe can be restricted, the leading end of the fastener can be positively caught by the guide groove and dust within the injection passage can be discharged by the second groove.

The invention according to embodiment 7 is as described above. Specifically, to the injection passage, there is connected the supply passage for supplying the fastener, while the supply passage is disposed offset to the center position or the injection passage. Here, when the supply passage is thus offset, the fastener tiptoe is easy to touch the inner surface of the injection passage and thus can be driven out while rotating along the inner surface of the injection passage. However, according to the invention, the guide portion is formed. Thus, since the tiptoe can be guided smoothly along the fastener driving direction, the position of the tiptoe and the attitude of the fastener can be stabilized to thereby reduce the occurrence of fastener poor driving.

The invention according to embodiment 8 is as described above. Specifically, since the guide portion is formed nearer to the leading end of the tool main body than the leading end of the fastener supplied to the injection passage, the tiptoe of a fastener to be driven can be positively guided by the guide portion.

The invention according to embodiment 2 is as described above. Specifically, since the guide portion is formed nearer to the leading end of the tool main body than the supply passage, the tiptoe of a fastener to be driven can be positively guided by the guide portion.

BRIEF DESCRIPTION OF THE DRAWINGS

FIGS. 6A to 6E are partially enlarged side views of the nose neighboring portion, and FIGS. 6F to 6I are partially enlarged section views of the nose neighboring portion when viewed from behind (grip side).

FIGS. 9A to 9I show how to drive out a fastener in a conventional contact nose. Specifically, FIGS. 9A to 9E are partially enlarged side section views of a nose neighboring portion, and FIGS. 9F to 9I are partially enlarged section views of the nose neighboring portion when viewed from behind (grip side).

FIGS. 10A and 10B are partially enlarged side section views of a nose neighboring portion having a contact nose structure. FIGS. 10C and 10D are partially enlarged side section views of a nose neighboring portion not having a contact nose structure.

FIG. 12A is a partially enlarged side view of the nose neighboring portion, and FIG. 12B is an X-X section view.

FIG. 13A is a partially enlarged side view of the nose neighboring portion, and FIG. 13B is a Y-Y section view.

DETAILED DESCRIPTION

Figure 1:
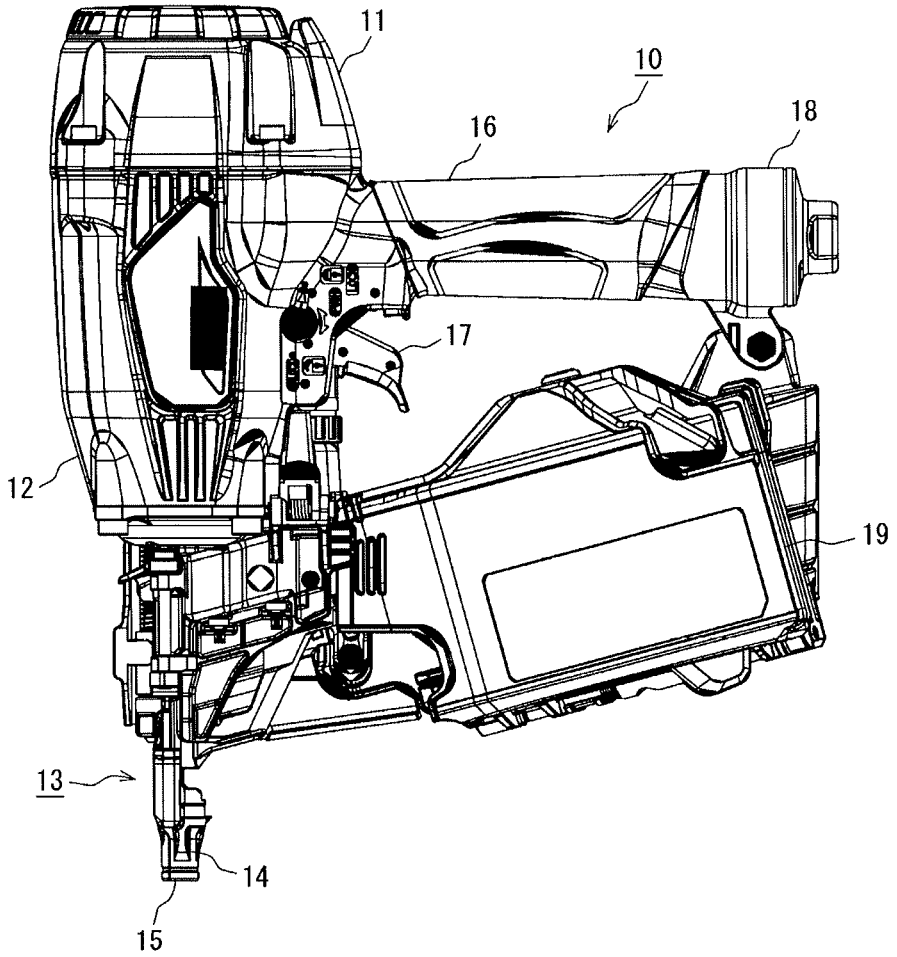
FIG. 1 is a side view of a fastener driving tool.

Description is given of an embodiment of the invention with reference to the drawings. A fastener driving tool 10 according to the embodiment is a pneumatic driving tool for driving fasteners 41 using compressed air. As shown in FIG. 1, it includes a tool main body 11 having a nose portion 13 and a magazine 19 connected to the tool main body 11 laterally of the nose portion 13.

The main body 11 includes a body housing 12 and a grip housing 16 connected to each other substantially at right angles. The body housing 12 includes therein a hitting cylinder with a hitting piston slidably stored therein. The hitting piston includes on its lower surface a driver 21 connected thereto for hitting the fasteners 41, whereby, when the hitting piston operates, the fasteners 41 can be driven by the driver 21.

The nose portion 13 for injecting the fasteners 41 is formed in the lower leading end of the body housing 12, while the driver 21 is slidably guided in the direction of the nose portion 13.

Figure 2:
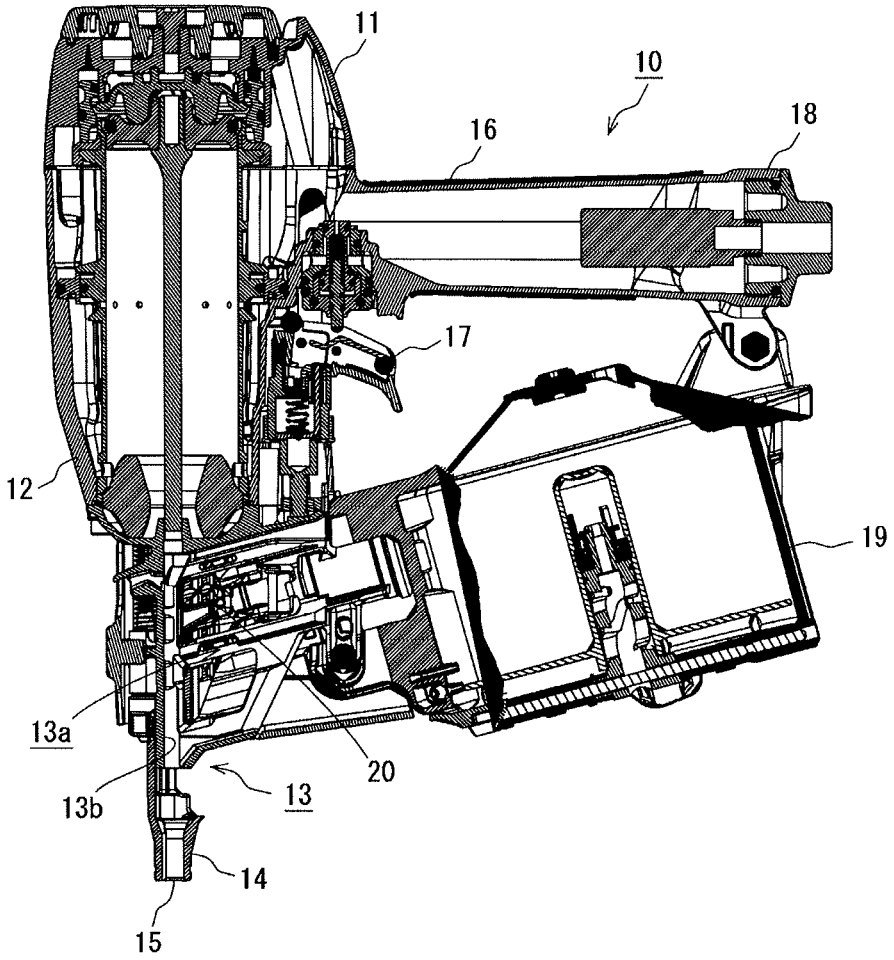
FIG. 2 is a side section view of the fastener driving tool.

As shown in FIG. 2, behind the nose portion 13, there is formed a supply passage 13*a* for supplying the fasteners 41 to the nose portion 13. The supply passage 13*a* communicates with the inside of the magazine 19, while the connected fasteners pulled out from the side portion of the magazine 19 are supplied through the supply passage 13*a* to the nose portion 13. Here, in the magazine 19, there are stored connected fasteners produced by connecting the multiple fasteners 41 together by a connecting member and winding them in a coil-like shape.

The supply passage 13*a,* as shown in FIG. 2, includes a fastener supply mechanism having a feed member 20 for sequentially supplying the fasteners 41 to the nose portion 13. The feed member 20 of the fastener supply mechanism can be operated to advance and retreat in linking with a fastener driving operation, and, using a feed pawl 34 for gripping and feeding the shaft portions 41*b* of the fasteners 41, can execute a feed operation to supply the fasteners 41 within the magazine 19 into the nose portion 13. By the feed operation of the feed member 20, the fasteners 41 arranged along the supply passage 13 can be supplied sequentially to the drive-out position of the nose portion 13.

The nose portion 13 includes in its leading end a substantially cylindrical contact nose 14 which is disposed movable vertically relative to the nose portion 13 and can be pressed against a driven member. This contact nose 14 is slidably mounted on the leading end of the nose portion 13. The contact nose 14 is connected to a contact arm constituting a safety device of the fastener driving tool 10 and, when it is pressed against the driven member 40 and is slid, the contact arm is moved upward integrally therewith. The upward movement of the contact arm makes valid the operation of the trigger 17.

Specifically, when the trigger 17 is operated with the contact nose 14 pressed against the driven member 40 (or, when the contact nose 14 is pressed against the driven member 40 with the trigger 17 operated), compressed air supplied from an air supply source such as an air compressor connected to an end cap portion 18 formed in the rear end of a grip housing 15 is supplied into a hitting cylinder, where the compressed air acts on a hitting piston to drive it, whereby a driver 21 connected to the hitting piston drives the first fastener 41.

Then, while the first fastener 41 is disconnected from the connecting member and is driven out from the injection port 15 of the nose portion 13, the attitude thereof when it is guided into the injection passage 13*b* by the fastener supply mechanism is not maintained but is inclined due to the resistance when disconnected, whereby it is driven out while changing its attitude with its tiptoe and head in contact with the inner peripheral wall of the injection passage 13*b*. When a normal feed operation is not carried out for some reasons, there is a possibility that the tiptoe of the fastener 41 does not go toward the injection passage 13*b* but the fastener is driven toward the grip direction. To eliminate this possibility, on the lower side of the opening of the supply passage 13*a,* there are formed a taper portion for guiding the tiptoe of the fastener 41 to the injection passage 13*b* and a cylindrical portion having no opening, whereby the leading end of the fastener can always be positively guided to the injection passage 13*b*.

Figure 10A:
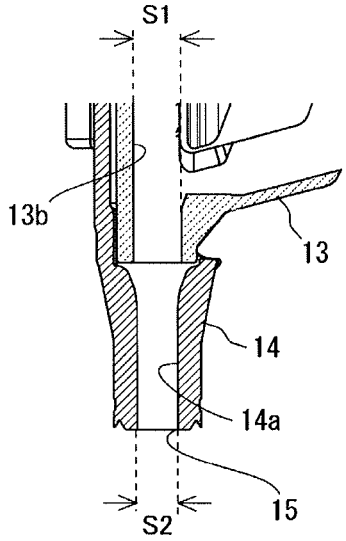
FIGS. 10A to 10D explain the structure of a contact nose. Specifically.

While the attitude of fastener 41 is guided stably also by an injection route within the contact nose 14 similarly to the injection passage 13*b* of the nose portion 13, the fastener 41 is driven out from the injection port 15 opened in the leading end of the contact nose 14. That is, the substantially cylindrical contact nose 14, as shown in FIGS. 10A and 10B, while having an inside diameter S2 substantially equal to the inside diameter S1 of the injection passage 13*b* of the nose portion 13, guides the attitude of the fastener 41, and, when driving the fastener 41, projects beyond the nose portion 13 to come into contact with the driven member 40 and drives out the fastener 41 from the leading-end injection port 15. Therefore, even while the nose portion 13 is floated due to a reaction generated in the fastener driving operation and the adjustment of driving depth (when there exists a clearance S shown in FIG. 10B), the attitude of the fastener 41 can be guided until completion of the driving operation. That is, even when there is used the fastener 41 having small head and line diameter and a short length, even after it is driven out from the injection passage 13*b* of the nose portion 13, its inclination angle within the contact nose 14 is prevented from increasing, thereby being able to reduce the occurrence frequency of fastener buckling.

Figure 10C:
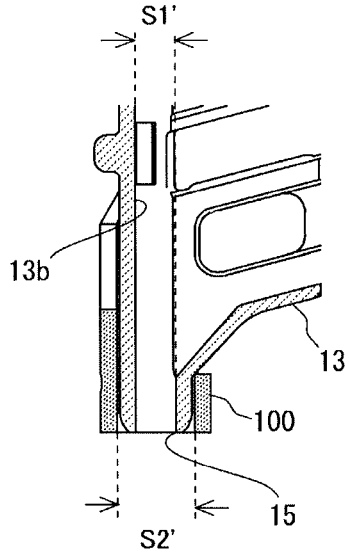
Figure 10B:
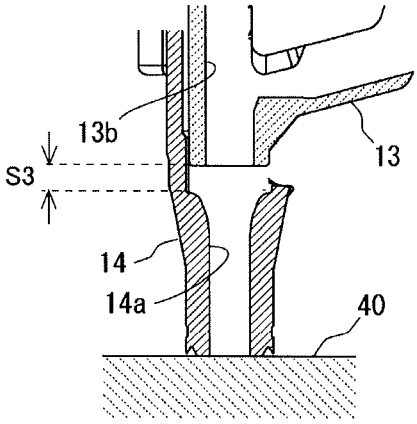
Figure 10D:
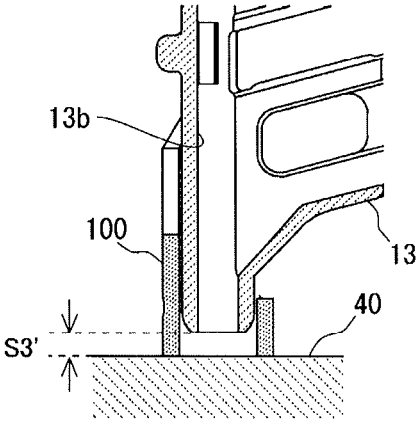

When such contact nose 14 as this embodiment is not included, as shown in FIGS. 10C and 10D, the inside diameter S2' of a contact member 100 is larger than the inside diameter S1' of the injection passage 13*b* of nose portion 13. Thus, when the nose portion 13 is floated due to the reaction in driving and the adjustment of driving depth, there is produced a clearance S3' between the nose portion 13 and driven member 40 and, in the portion of this clearance S3', the attitude of the fastener 41 cannot be guided. This raises a possibility that the inclination angle of the fastener 41 within the contact nose 14 can increase.

Figure 3:
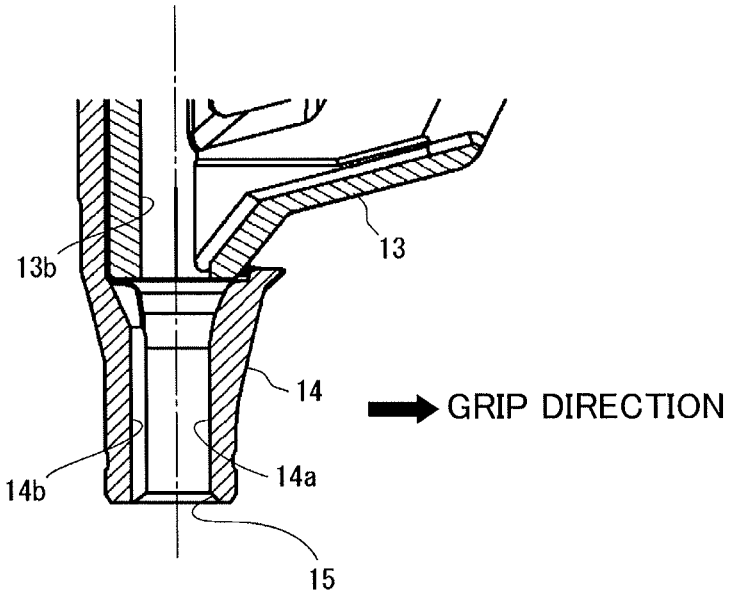
FIG. 3 is a partially enlarged side view of a nose neighboring portion.
Figure 5A:
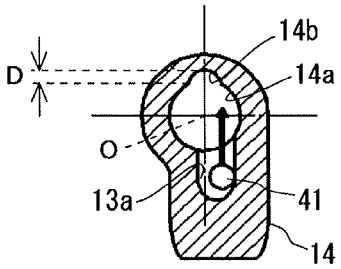
FIGS. 5A to 5C are section views to show how a fastener is guided by a guide groove within the contact nose.
Figure 5B:
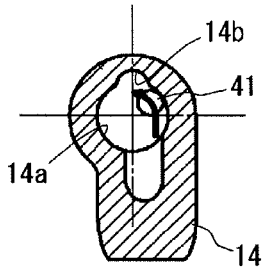
Figure 5C:
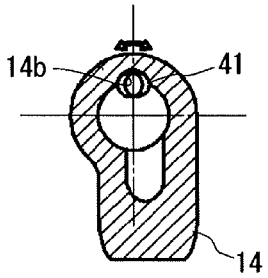
Figure 6A:
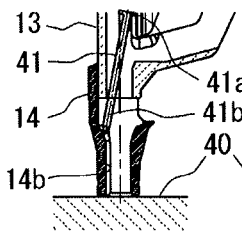
FIGS. 6A to 6I show how the fastener is driven out. Specifically.
Figure 6F:
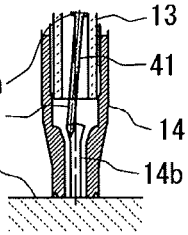
Figure 6B:
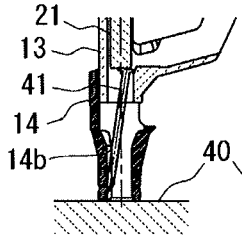
Figure 6G:
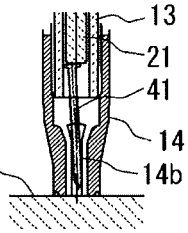
Figure 6C:
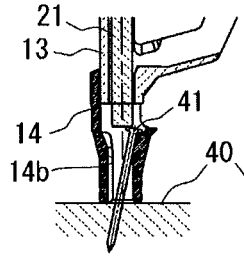
Figure 6H:
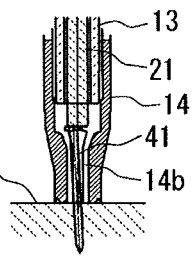
Figure 6D:
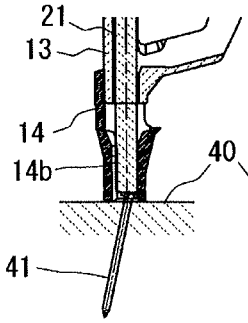
Figure 6I:
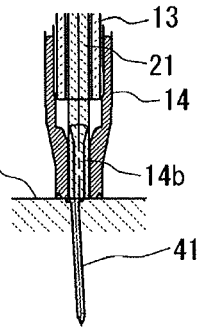
Figure 6E:
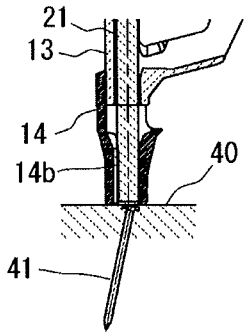

As shown in FIG. 3, in the inner periphery 14*a* of the contact nose 14 of this embodiment, as a guide portion for guiding the tiptoe of the fastener 41, there is formed a guide groove 14*b* along the driving direction of the fastener 41. Formation of the guide groove 14*b,* as shown in FIG. 5 and the like, causes the section of the injection passage 13*b* to have a non-circular shape. In other words, the guide groove 14*b* is formed by providing contours having different distances from the center of the section of the injection passage 13*b*. Here, in this embodiment, the guide groove 14*b* is formed as the guide portion. However, this is not limitative but the guide portion may be formed by providing contours having different distances from the center of the section of the injection passage 13b. For example, the section of the injection passage 13*b* may be formed to a polygon or a partially missing circle. Even when the section is formed to have a corner in this manner, the corner can be used to form the guide portion.

Figure 4:
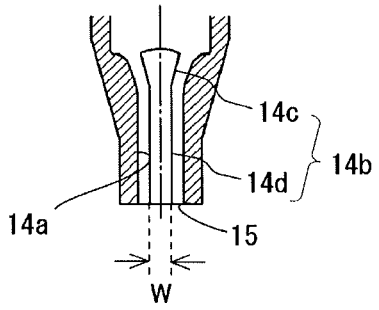
FIG. 4 is a partially enlarged side view of the leading end of a contact nose when viewed front behind (grip side).

The guide groove 14*b* is formed in such inner surface of the inner periphery 14*a* as is opposite to the grip. In this guide groove 14*b,* as shown in FIG. 4, its introduction portion 14*c* formed in the start end thereof has such spread shape as can easily pick up the fastener 41, while its linear portion 14*d* on the injection port 15 side has a narrower shape than the introduction portion 14*c*.

Formation of such guide groove 14*b,* as shown in FIGS. 5 and 6, causes the tiptoe of the fastener 41 injected from the nose portion 13 to be guided to the guide groove 14*b,* whereby the vibration of the fastener 41 within the contact nose 14 can be reduced more than conventionally and thus can stabilize the driving attitude.

Here, since the guide groove 14*b* is used to control the attitude of the fastener 41 after driven by the driver 21, it may be situated nearer to the leading end of the tool main body than the leading end of the fastener 41 before it is supplied into the injection passage 13*b* and is driven. Thus, the guide groove 14*b* may be formed nearer to the tool main body leading end than the opening, of the fastener 41 supply passage 13*a*.

To reduce the tiptoe of the fastener 41 and stabilize the attitude, the tiptoe of the fastener 41 when swung right and left in driving may only be caught. Therefore, the guide groove 14*b* may not always be so formed as to continue to the injection port 15. For example, the guide groove 14*b* may be formed only in the nose portion 13 but not in the contact nose 14.

As shown in FIG. 5, when the supply passage 13*a* connected to the nose portion 13 for supplying the fastener 41 is offset to the center position O of the injection passage 13*b*, since the fastener 41 is driven out with its tiptoe adjacent to a portion of the injection passage 13*b*, the tiptoe is easy to touch the inner peripheral surface of the injection passage 13*b*, thereby making it hard to stabilize the driving attitude of the fastener 41. However, when the guide groove 14*b* is formed as in this embodiment, after touch with the inner peripheral surface of the injection passage 13*b*, the tiptoe moving along the inner peripheral surface is caught by the guide groove 14*b* to thereby be able to stabilize the attitude of the fastener 41.

In this embodiment, since the guide groove 14*b* is formed in the inner surface opposite to the grip, the tiptoe of the fastener 41 is caught on the side opposite to the grip and thus the fastener 41 is driven out with its head 41*a* inclined toward the grip. In this structure, since the side of the fastener driving tool 10 opposite to the grip is inclined toward a lifting direction due to the reaction in fastener driving, the head 41*a* of the fastener 41 driven out while inclined toward the grip is pushed by the contact nose 14 to thereby cause the shaft of the fastener 41 to approach a driven surface perpendicularly. Thus, the fastener 41 is driven into the driven surface substantially perpendicularly.

Since the guide groove 14*b* (specifically, the linear portion 14*d*) of this embodiment has a width W (see FIG. 4) smaller than the diameter of the head 41*a* of the fastener 41 (the usable maximum diameter of the head 41*a* of the fastener 41) to thereby prevent the head 41*a* of the fastener 41 from entering the guide groove 14*b*, the head 41*a* of the fastener 41 can be positively guided without degrading the guide performance of the inner peripheral surface of the contact nose 14, whereby the attitude of the fastener 41 within the contact nose 14 can be stabilized.

Since the guide groove 14*b* of this embodiment has a depth D (see FIG. 5) smaller than the diameter of the shaft portion 41*b* of the fastener 41 (the usable maximum diameter of the shaft portion 41*b* of the fastener 41), the shaft portion 41*b* of the fastener 41 is prevented from entering the guide groove 14*b* more than necessary, thereby eliminating great influence on the fastener 41 inclination restricting performance.

Here, the shape of the guide groove 14*b* is not limited to the above embodiment.

Figures 7A, 7B, 7C, 7D:
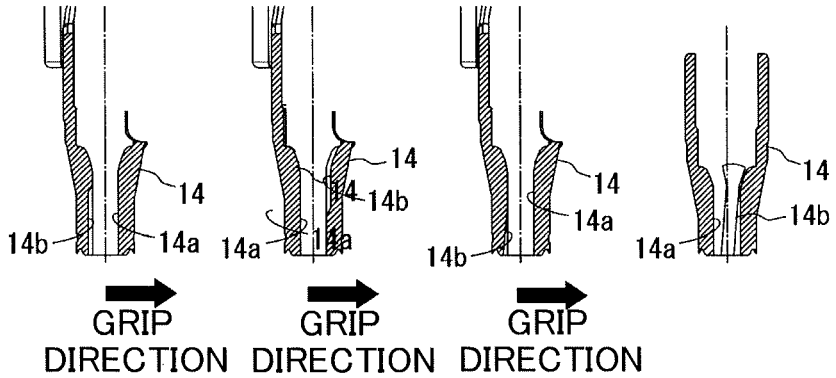
FIGS. 7A to 7M are views of a modification of the contact nose.

For example, as shown in FIG. 7A, the guide groove 14*b* may not be formed in the taper portion of the contact nose 14 but may be formed only in the linear portion of the contact nose 14.

Also, as shown in FIG. 7B, the guide groove 14*b* may not be formed adjacent to the injection port 15 but may be formed on the grip side.

And, as shown in FIG. 7C, the guide groove 14*b* may be formed only adjacent to the injection port 15.

Figures 7E, 7F:
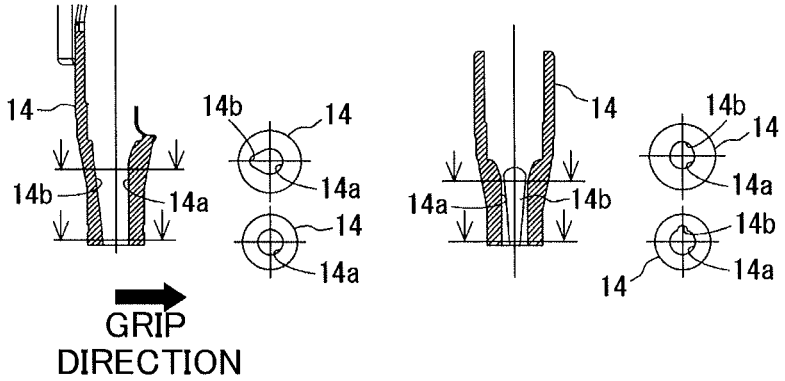

As shown in FIG. 7D, the guide groove 14*b* may also be formed inclined relative to the driving direction of the fastener 41. With this structure, as shown in FIG. 8, since the supply passage 13*a* is offset, even when the fastener 41 is driven out with its tiptoe rotating from an oblique direction, the tiptoe can be guided smoothly along the rotation direction of the fastener 41 to thereby stabilize the direction of the tiptoe. Here, when inclining the guide groove 14*b*, preferably, as shown in FIG. 7D and FIG. 8, the upper end (existing opposite to the injection port 15) of the guide groove 14*b* may be disposed on the offset side of the supply passage 13*a*, while the lower end (on the injection port 15 side) thereof may be disposed opposite to the grip. In this case, the fastener 41 can be guided without going against the rotation direction thereof; and, when the fastener 41 is injected, its tiptoe is guided in the direction opposite to the grip and its head is guided while inclined toward the grip, the fastener driving tool 10, which is inclined in the direction where its side opposite to the grip is lifted due to the reaction in fastener driving, pushes the shaft portion of the fastener 41 to approach the driven surface perpendicularly, whereby, while absorbing the inclination of the fastener 41, the fastener 41 can be driven into the driven surface substantially perpendicularly, Also, as shown in FIG. 7E, the guide groove 14*b* may be formed such that it reduces in size continuously from top to bottom. Here, the section of the inner periphery 14*a* adjacent to the injection port 15 may be formed to a substantially circular shape.

Or, as shown in FIG. 7F, the guide groove 14*b* may be formed to narrow continuously from top to bottom.

Figures 7G, 7H, 7I, 7J:
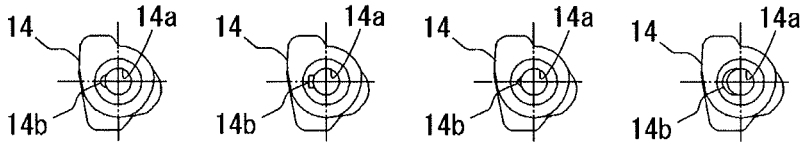

The section of the guide groove 14*b* is not limited to above embodiment. It may also be formed to a semicircle as shown in FIG. 7G, a square groove as shown in FIG. 7H, a triangular groove as shown in FIG. 7I, or a wide groove as shown in FIG. 7J.

Figures 7K, 7L, 7M:
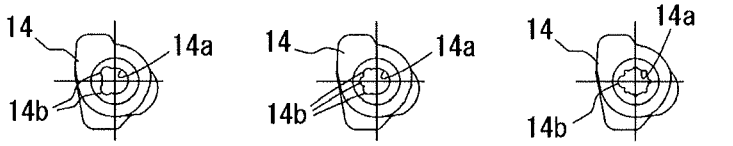
Figure 8A:
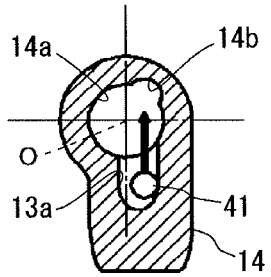
FIGS. 8A to 8D are section views of the modification with a guide groove inclined, showing how a fastener is guided by a guide groove within the contact nose.
Figure 8B:
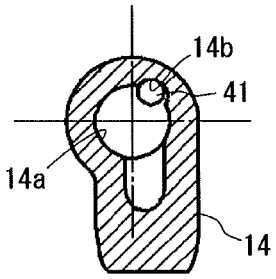
Figure 8C:
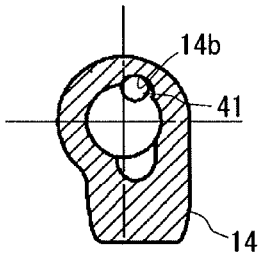
Figure 8D:
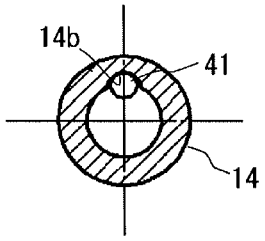

Also, the number of guide grooves 14*b* is not limited to one but, as shown in FIGS. 7K and 7L, multiple guide grooves 14*b* may be formed at adjacent positions in the peripheral direction of the inner periphery 14*a* of the injection port 13*b* (positions shifted in the peripheral direction). In this case, when the fastener 41 is driven out with its tiptoe rotating, even if the tiptoe cannot be caught by the first guide groove 14*b* due to the impact of the fastener driving tool 10, the tiptoe can be positively caught by the next (second) guide groove 14*b*, whereby the direction of the tiptoe can be stabilized.

Also, as shown in FIG. 7M, in the inner periphery 14*a* surface of the injection passage 13*b*, for example, there may be formed multiple grooves different in size and shape from each other, and at least one of them is formed deeper and wider than the remaining grooves and is used as a guide groove 14*b* which has a function to catch the tiptoe of the fastener 41 when it enters along the inner peripheral surface. In this case, even when the small grooves cannot catch the tiptoe of the fastener 41. they can restrict the vibration of the tiptoe due to resistance. Also, they can also be used as discharge passages for dust or the like.

In the above embodiment, description has been given with reference to the fastener driving tool 10 including the contact nose 14. However, this is not limitative but there may also be used a fastener driving tool 10 not including the contact nose 14. In the case of the fastener driving tool 10 not including the contact nose 14, a guide portion may be formed in the nose portion 13 formed integrally with the tool main body 11. For example, the guide portion 14*b* may be formed in such nose portions 13 as shown in FIGS. 11 to 13.

Figure 11:
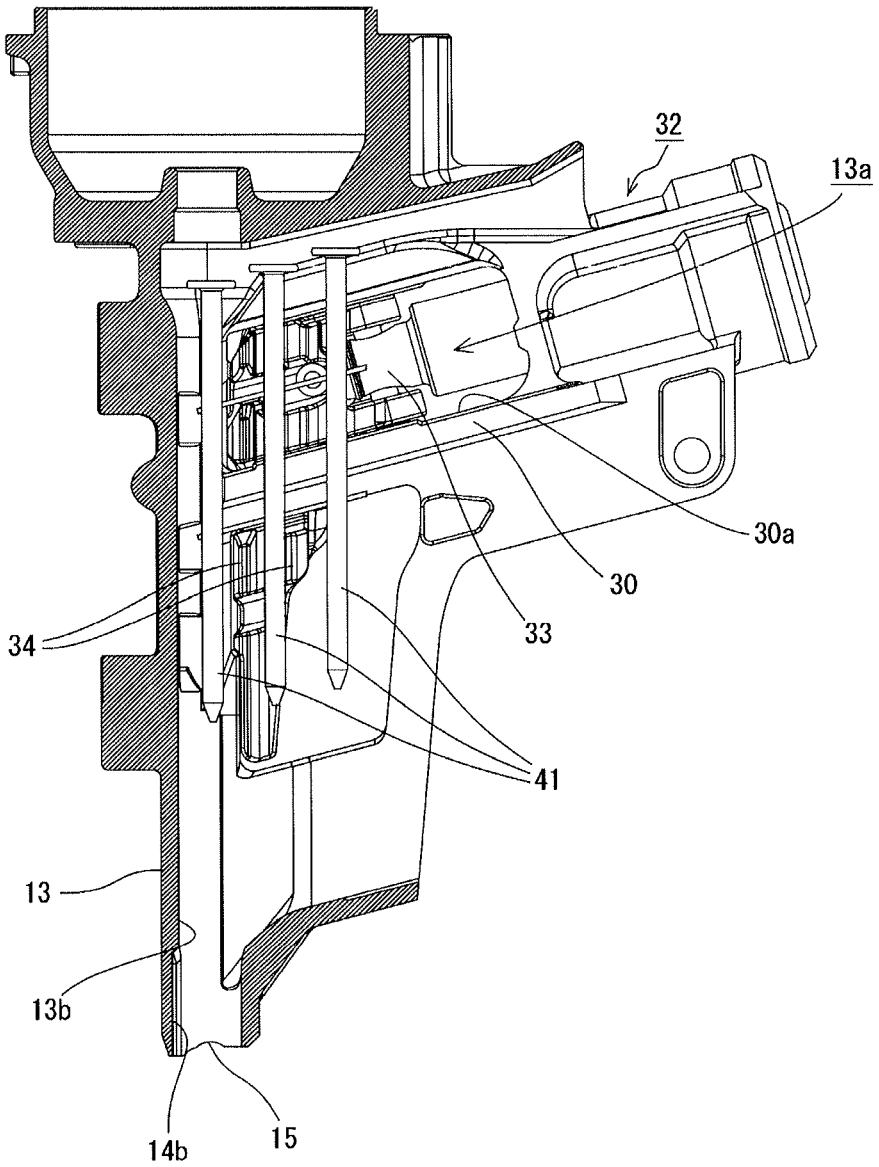
FIG. 11 is a side section view of a fastener driving tool according to a modification in which a guide portion is formed in a nose portion.
Figure 12A:
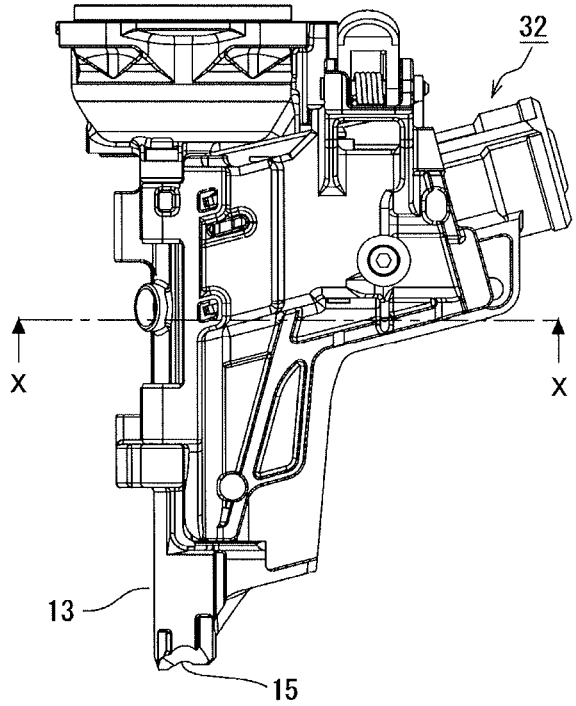
FIGS. 12A and 12B show a nose neighboring portion of a fastener driving tool according to the modification with the guide portion formed in the nose portion. Specifically.
Figure 12B:
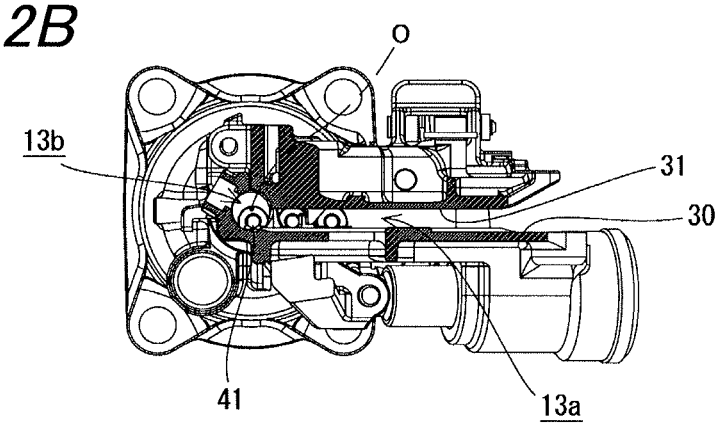
Figure 13A:
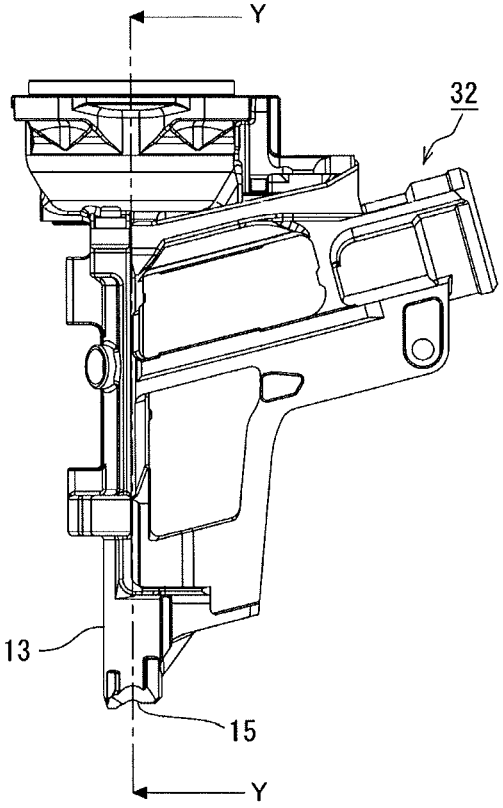
FIGS. 13A and 13B show a nose neighboring portion of a fastener driving tool according to the modification with the guide portion formed in the nose portion. Specifically.
Figure 13B:
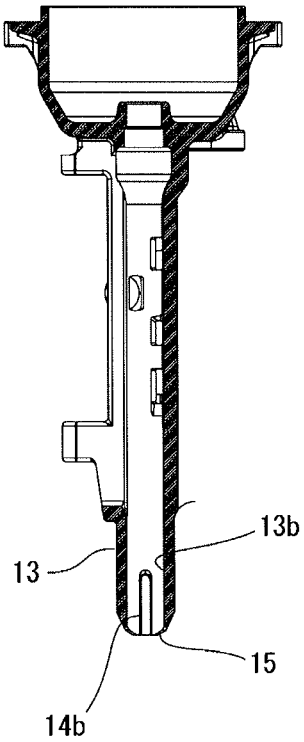

Here, in the examples shown in FIGS. 11 to 13, in one side surface of the injection passage 13*b*, there is formed an opening for receiving the connected fasteners 41 into the injection passage 13*b*. A fixed guide wall 30 extending backward continuously from one side surface of the opening and a door member 31 disposed opposed to the fixed guide wall 30 and pivotally supported openably and closably define a supply passage 13*a* for guiding the fasteners 41 to the injection passage 13*b*.

On the back surface side of the fixed guide wall 30, there is arranged a nail supply mechanism 32 constituted of a feed piston and a piston/cylinder mechanism storing the feed piston therein. The feed piston is slidable along the supply passage 13*a* and feed pawls 34 are mounted on the leading end of a piston rod 33. The feed pawls 34 are projected into the supply passage 13*a* through a window hole 30*a* formed in the fixed guide wall 30 and can be reciprocated along the supply passage 13*a*. Due to the reciprocating motion of the feed pawls 34, the fasteners 41 within the supply passage 13*a* can be sequentially supplied to the injection passage 13*b*.

Like the nose portion as shown in FIGS. 11 to 13, in a structure where the supply passage 13*a* of the fasteners 41 are arranged offset to the center position of the injection passage 13*b* (the center O of the supply passage 13*a* of the fasteners 41 is shifted relative to the center line of the injection passage 13*b*), the tiptoe of the fastener 41 is easy to touch the inner peripheral surface of the injection passage 13*b* to make it hard to stabilize the fastener driving attitude. However, as described above, the guide portion 14*b* is easy to stabilize the attitude of the fastener 41.

Here, the guide portion of this embodiment is suitable for a fastener driving tool 10 using coil-like wound connected fasteners. In other words, in a driving tool using connected nails (so called stick nails) produced by connecting together fasteners linearly, the necessity of the guide portion of this embodiment is low. The reason for this is that, in the stick nails, since the first fastener is guided by its adjoining fastener, its inclination can be restricted to some degrees even without employing a guide mechanism for attitude control. On the other hand, in a driving tool using coil-like connected fasteners, since it is difficult to drive out the fasteners with the attitudes thereof controlled, a cylindrical portion is formed in the leading end of the nose to thereby regulate the inclination of the fastener. By providing the guide groove (portion) 14*b* in the cylindrical portion, the attitude of the fastener 41 can be controlled further positively.

In solving the above issue, the invention may also be structured as follows.

[1] A fastener driving tool includes a contact nose slidably formed in a leading end of a nose portion for driving fasteners. The contact nose has an inside diameter substantially equal to an inside diameter of the nose portion, guides attitudes of the fasteners. When driving the fasteners, the contact nose projects beyond the nose portion and touches a driven member, and drives the fasteners from its leading-end injection port. In an inner periphery of the contact nose, a guide groove is formed along a driving direction of the fasteners for guiding tiptoes of the fasteners.

[2] In the fastener driving tool according to the article [1], the guide groove is formed in an inner surface of the contact nose at an opposite side of a grip.

[3] In the fastener driving tool according to the article [1] or [2], the guide groove has a width smaller than a diameter of a head of the fastener.

[4] In the fastener driving tool according to any one of the articles [1] through [3], the guide groove has a depth smaller than a diameter of a shaft portion of the fastener.

[5] In the fastener driving tool according to any one of the articles [1] through [4], a supply passage for supplying the fasteners is connected to the nose portion. The supply passage is arranged offset to a center position of the injection port. The guide groove is formed inclined relative to the driving direction of the fasteners.

[6] A fastener driving tool includes a contact nose slidably formed in a leading end of a nose portion for driving fasteners. The contact nose has an inside diameter substantially equal to an inside diameter of the nose portion, guides attitudes of the fasteners. When driving the fasteners, the contact nose projects beyond the nose portion and touches a driven member, and drives the fasteners from its leading-end injection port. In an inner periphery of the contact nose, multiple guide grooves are formed along a driving direction of the fasteners for guiding tiptoes of the fasteners. The multiple guide grooves are formed at adjacent positions in a peripheral direction of the inner periphery of the contact nose.

[7] A fastener driving tool includes a contact nose slidably formed in leading end of a nose portion for driving fasteners. The contact nose has an inside diameter substantially equal to an inside diameter of the nose portion, guides attitudes of the fasteners. When driving the fasteners, the contact nose projects beyond the nose portion and touches a driven member, and drives the fasteners from its leading-end injection port. In an inner periphery of the contact nose, a guide groove for guiding tiptoes of the fasteners and a second groove shallower than the guide groove are formed. The guide groove and the second groove are respectively formed along a fastener driving direction.

What is claimed is:

1. A fastener driving tool for injecting a fastener from an injection passage formed in a leading end of a tool main body, wherein the injection passage includes therein a guide portion formed along a driving direction of the fastener for guiding the fastener, the guide portion is formed by providing contours having mutually different distances from a center axis of the injection passage in a same cross-section of the injection passage that is perpendicular to the center axis, and the guide portion is disposed opposite to a grip in an inner surface of the injection passage.

2. The fastener driving tool according to claim 1, the guide portion is configured to guide a tiptoe of the fastener opposite to the grip and to guide a head of the fastener while inclined toward the grip.

3. The fastener driving tool according to claim 1, wherein the guide portion is formed of a guide groove.

4. The fastener driving tool according to claim 3, wherein the guide groove has a width smaller than a diameter of a head of the fastener.

5. The fastener driving tool according to claim 3, wherein the guide groove has a depth smaller than a diameter of a shaft portion of the fastener.

6. The fastener driving tool according to claim 3, wherein a second groove is formed shallower than the guide groove.

7. The fastener driving tool according to claim 1, wherein a supply passage for supplying the fastener is connected to the injection passage, and the supply passage is disposed offset to a center position of the injection passage.

8. The fastener driving tool according to claim 1, wherein the guide portion is formed nearer to the leading end of the tool main body than a leading end of a fastener supplied to the injection passage.

9. The fastener driving tool according to claim 1, wherein a supply passage for supplying the fastener is connected to the injection passage, and the guide portion is formed nearer to the leading end of the tool main body than the supply passage.

10. A fastener driving tool for injecting a fastener from an injection passage formed in a nose portion of a tool main body, comprising:

a contact nose that has a substantially cylindrical injection route having an inside diameter substantially equal to an inside diameter of the injection passage formed in the nose portion, wherein the injection route includes therein a guide portion formed along a driving direction of the fastener for guiding the fastener, the guide portion is formed by providing contours having mutually different distances from a center axis of the injection route in a same cross-section of the injection route that is perpendicular to the center axis, and the guide portion is disposed opposite to a grip in an inner surface of the injection route.

* * * * *